US005143729A

United States Patent [19]

Thompson

[11] Patent Number: 5,143,729

[45] Date of Patent: Sep. 1, 1992

[54] FADE RESISTANT WATER AND SOIL REPELLENT COMPOSITION FOR FABRIC

[75] Inventor: Peter B. Thompson, Blagdon Bristol, England

[73] Assignee: Fadeguard, Inc., N.H.

[21] Appl. No.: 659,546

[22] Filed: Feb. 25, 1991

Related U.S. Application Data

[63] Continuation of Ser. No. 891,271, Jul. 29, 1986, abandoned.

[51] Int. Cl.[5] ..... D06M 13/152; D06M 13/13; D06M 13/352; D06M 15/256

[52] U.S. Cl. ..... 424/402; 427/385.5; 427/389.9; 427/393.4; 524/544; 524/545; 524/546; 524/560; 524/562; 524/91; 524/336; 524/337; 524/338; 252/8.6; 424/45

[58] Field of Search ..... 427/385.5, 389.9, 393.3, 427/393.4; 524/544, 545, 546, 560, 562, 91, 336–338; 252/8.6, 8.9; 424/401, 402

[56] References Cited

U.S. PATENT DOCUMENTS

| | | | |
|---|---|---|---|
| 3,578,487 | 5/1971 | Knell et al. | 427/393.4 |
| 3,592,686 | 7/1971 | Barber et al. | 427/393.4 X |
| 3,598,514 | 8/1971 | Sello et al. | 427/393.4 X |
| 3,632,391 | 1/1972 | Whitfield et al. | 427/393.4 X |
| 3,782,898 | 1/1974 | Mandell, Jr. | 427/393.4 X |
| 4,143,206 | 3/1979 | Jäger | 427/393.4 X |
| 4,219,605 | 8/1980 | Rohringer | 427/393.3 X |
| 4,219,625 | 8/1980 | Mares et al. | 528/272 |
| 4,594,286 | 6/1986 | McKinney et al. | 427/393.3 X |

*Primary Examiner*—Thurman K. Page
*Assistant Examiner*—Edward J. Webman
*Attorney, Agent, or Firm*—Rines and Rines

[57] ABSTRACT

Ultra-violet screening compounds have been combined with hydrophobic fluid and solid-repellent compounds to provide a spray, and ultimately a thin solid adherent layering, deposit or coating for fabrics and the like that simultaneously imparts both fade or photodegradiation-ressiting properties, and fluid and soil repellent properties.

17 Claims, No Drawings

FADE RESISTANT WATER AND SOIL REPELLENT COMPOSITION AND FABRIC

This is a continuation of application Ser. No. 891,271 filed Jul. 29, 1986, now abandoned.

The present invention relates to methods of and materials for protecting fibers and fabrics or textiles and the like from both fading and other deleterious effects of ultra-violet radiation and from the soiling effects of water, oil and other soiling elements.

The art is replete with ultra-violet radiation screening or stabilizing agents for incorporation with synthetic fibers and other articles usable to form fabrics for household furnishings and other purposes and articles of clothing and the like that are to be protected from fading, degradation, deterioration and discoloring by the ultra violet rays. Among such, for example, are U.S. Pat. No. 3,888,821 (disclosing the use of a substituted benzotriazole, benzophenone or triazine, for example, absorbed in an aromatic polyamide fiber); U.S. Pat. No. 3,379,675 (disclosing benzotriazole and a tris-phenol, for example, for stabilizing polyether-based spandex fibers); and U.S. Pat. No. 4,251,433 (disclosing the coating of the extruded organic fibers or other articles with heterocyclic ester ultra-violet stabilizers). The mechanism for such screening action is believed to reside in one or more of filtering action or preferential absorption of deleterious incident wavelengths with dissipation through heat fluorescence or similar phenomena. Sometimes the UV-screening compounds are "spun-in" prior to fiber extrusion, sometimes "dyed in", sometimes "coated-on", and sometimes microdispersed. Similar compounds have also been used for UV-absorption when applied to the human skin (U.S. Pat. No. 3,004,896, for example) and to photographic dye images and the like (U.S. Pat. Nos. 4,447,511 and 4,308,328, as illustrations).

As an entirely separate and heretofore unrelated art of fabric or textile treatment, numerous different-propertied compounds have been coated on or otherwise used as a finish for the fabric material, for imparting water, soil, grease or oil repellency, durability against laundering and abrasion, and related properties quite different from UV screening and the phenomena underlying the same. Examples of such finishing compounds are disclosed in, as illustrations, U.S. Pat. Nos. 3,549,698; 3,733,357; 3,786,089; 3,949,112; 4,077,770; 4,192,754; 4,219,625; 4,401,780; 4,472,466; 4,473,371; 4,518,649; and 4,539,006. Suitable compounds for this very different function include fluorinated polyesters, fluoromethylated diene polymers and copolymers, fluorochemical soil release agents, polyfluoroalkyl compositions and similar compounds.

It has not heretofore been apparent that either there is or can be a relationship between the types of compounds used for ultra-violet screening phenomena and those imparting repellent properties by very different phenomena, or that such compounds can be somehow combined or unitized without interference or chemical interaction or other property-destroying effects, so as to permit the functioning of these distinct screening and repellent phenomena simultaneously particularly with a thin enough combined layering or absorption that also maintains the hand, color, strength and other original properties of the fibers or fabric, in such combination, that can, where desired, be efficaciously sprayed.

Underlying the present invention is just such a discovery wherein it has surprisingly been found possible to combine ultra-violet screening agents and water, soil and grease-repelling agents as a thin film fabric finish or spray deposition or the like, without impairing the UV stabilizing or absorbing properties imparted by the former or the efficacy of the repellency properties imparted by the latter and without deleterious chemical interaction or impaired adhesion even though combined together in such thin film.

An object of the invention, accordingly, is to provide a new and improved method of and composite material for simultaneously imparting ultra-violet screening and absorbing properties and fluid and soil repellent properties to organic and related fibers and fabrics or textiles, without sacrificing the desired hand, coloration, flexibility or other original properties of the same.

A further object is to provide a thin solidified admixed layer or coating imparting such novel properties.

Other and further objects will be explained hereinafter and are more particularly delineated in the appended claims.

In summary, the invention provides a method of simultaneously providing UV screening and fluid and soil repellent properties to organic fibers, fabrics and the like, that comprises, combining a fluid and soil repellent solution with a UV screening compound soluble in and non-reactive with said solution, thoroughly dissolving the said screening compound in the repellent solution in a ratio range of from 2–30% to 98–70% to provide sprayable particles from a few to several hundred microns (say, 1–300), and spraying the same as a thin deposit upon the fabric. Thus the invention provides a novel composition of matter containing an appropriate ultra-violet screening agent combined with a suitable water-repellent coating, formulated so that the composition can be applied to the surface of a variety of substrates, especially dyed fabrics, to protect them simultaneously from photodegradation and from staining as by various soiling agents, with the composition being applied by spraying or coating, to maximize efficiency. Preferred and best mode steps and materials are hereinafter set forth.

As before stated, underlying the invention is the discovery that a particular combining of ultra-violet screening agents and fluid and soil repellent agents, and the thin film application thereof to preferably organic fiber fabric or textile materials, for example, can result in the simultaneous imparting of both fade-resistant (and other deterioration) properties and resistance or repellency to wetting or soiling.

As will be more evident from the experimental results delineated in the following examples, preferred compositions comprise from about 2% to 30% of the screening agent (preferably hydroxy benzotriazoles) in about 98% to 70% of repellent solution in preferably a binder as of the fluorinated type used in 3M's "Scotchguard" trademark product (see, for example, 3M U.S. Patent Nos. 3,981,928 and 4,043,923) or Dupont's polyfluorinated polymers marketed under the trademark "Teflon".

Other screening agents which are useful are hydroxybenzophenones, e.g., Cyasorb 24, sold by American Cyanamid Co., etc. Other fluorinated binders, as well as binders which lack fluorine, but possess similar functional properties, i.e., hydrophobic character (e.g. polystyrene methyl methacrylate), can also be used. The weight percentage is based on solid binder, which may contain a plasticizer. Optionally, the spray composition may contain a fugitive dye which will permit the user to determine which areas of the surface have been sprayed. Examples of useful fugitive dyes are conventional indicator dyes, in combination with a volatile base, e.g., a mixture of phenolphthalein with ammonia, or well-known oxygen-reactive color fading dyes.

EXAMPLE 1

An acrylate solution (Rohm & Haas B72) was mixed with Riedel-DeHaen AG film and plastic discoloration UV inhibitor compounds Type HMB ("Riedel" 2-hydroxy-4-methoxybenzophenone) soluble in and non-reactive in the acrylate solution, in the ratio of approximately 4 parts to 98 parts of acrylate solution, and the combination was thoroughly admixed and mutually dispersed. The mixture was reduced with solvent to spraying viscosity. The same was then sprayed from an atomizing spray device in droplets of average size of about 5 microns as a thin layer (of the order of about 20 microns) on dry polyester fabric, and permitted to dry in an adhered thin film form.

The fabric was subjected to ultra-violet rays from a carbon arc lamp for 100 hours with noticeable improvement in fading properties. Water and oil droplets applied to the protected fabric were readily wiped off without strain both before and after the UV tests.

EXAMPLE 2

Three grams of o-hydroxyphenylbenzotriazole UV-absorber material ($C_{27}H_{36}ClO_3$--5-tertiary butyl-3-(5-chloro-2H-benzotriazol-2-yl)-4-hydroxy-benzene-propionic acid octyl ester--Ciba Geigy "Tinuvin 109", sometimes referred to as T-109) were dissolved, as above, in 50 grams of a fluorinated binder solution containing 12% solids (340 grams solution, 41 grams solids), as marketed under the trademark "Scotchguard", before referenced, to form a sprayable composition of about 5% UV screening agent and 95% repellent solution. The same was used as a spray with fluorinated hydrocarbon (DuPont's "Freon" solvents and "Freon"-ethanol mixtures) producing spray particles of the order of a few microns. Two sprayings upon dyed fabric, from about 6 inches away, were found to apply a thin adherent solid layer or coating that in dried spray particle form (1.2 grams of solid admixed coating consisting of 0.4 grams T-109) produced satisfactory fade stability and stain repellency results similar to those now reported for Example 3.

EXAMPLE 3

Another Ciba-Geigy o-hydroxyphenylbenzotriazole UV absorber ("Tinuvin 343") was mixed in the same "Scotchguard" type repellent solution of Example 2 (20% solids) and stirred to get all of the UV-absorber into solution, but in the ratio of 2 grams of T-343 to 50 grams of repellent solution. The solution was placed in a 100 ml bottle attached to a Chromist Spray apparatus (Gelman Instrument Co., Ann Arbor, Michigan), and a fine spray of several micron particle size was directed on dyed fabric (of nylon and cotton and polyester fibers) of red, blue and yellow colors for comparison with (1) unsprayed areas of the fabric and (2) unsprayed fabric areas fronted with an opaque cardboard layer. The fabric was exposed to a carbon arc generating substantial UV radiation for 160 hours with the following results as determined by fadeometer observations: 8 of 9 of the unsprayed fabric samples of all three colors showed definite photodegradation or fading effects as compared with the areas covered by the opaque cardboard; while all of the sprayed fabric samples showed either no signs of fading whatsoever or negligible degradation. The sprayed fabric simultaneously maintained its water repellency, as well.

EXAMPLE 4

A screening agent of o-hydroxybenzophenones ("Cyasorb 24" of American Cyanamid Co.) dissolved in "Scotchguard" fluorinated binder in the ratio of 7 to 93%, and spray-dried upon fabric.

EXAMPLE 5

"Tinuvin" 343 and/or 109 in hydrophobic polystyrene methyl methacrylate repellent solution (in proportions as in Example 2), with a "Freon TA" propellant.

EXAMPLE 6

The formulation of Example 3 with a fugitive dye indicator (phenolphthalein-ammonia) to show the sprayed areas combined with an ammonia volatile base. Alternatively, thymolphthalein indicator may be used that changes from blue to colorless on pH change.

With UV screening elements of the type of the T-109 and T-343, etc. preferred limits of weight per square foot are from about 0.1 gm/ft$^2$ to about 1 gram, if slight yellowing is not desired. For brown or red colored fabrics that do not show the yellowing or shade shift, up to several grams can be used. The preferred limits of the "Scotchguard" type repellent is from a few tenths to about 3 grams/ft$^2$ depending upon the degree of repellency protection desired. The dried spray particle combination layer, indeed, appears to make more effective use of the UV absorber than without the repellency product combined therewith.

Further embodiments will occur to those skilled in this art, and such are considered to fall within the spirit and scope of the invention as defined in the appended claims.

What is claimed is:

1. A fabric treatment spray which is effective to impart fade resistance and fluid and soil repellency to fabric without impairing the hand, coloration, or flexibility of the fabric, and which comprises a UV absorbing compound selected from the group consisting of hydroxybenzotriazoles, hydroxybenzophenones, hydroxymethyoxybenzophenones, and hydroxyphenylbenzotriazoles, dissolved in a non-reactive fluid-repellent and soil-repellent fluorinated polymeric binder solution to permit spraying of particles of the combined ingredients in a micron particle size in the range of 1 to 300, the ratio range of UV absorbing compound to repellent being from about 2–30% to 98–70%, wherein the limits of weight per square foot of spray, as applied in a thin layer of about 20 microns, are from about 0.1 gram per square foot to about 1 gram per square foot of UV absorbing compound and from about 0.1 gram per square foot to about 3 grams per square foot of binder solution.

2. A fabric treatment spray according to claim 1, wherein the UV absorbing compound is selected from the group consisting of hydroxybenzophenones and hydroxybenzotriazoles.

3. A fabric treatment composition which is effective to impart fade resistance and fluid and soil repellency to fabric without imparting the hand, coloration, or flexibility of the fabric, and which comprises a UV absorbing compound selected from the group consisting of hydroxybenzotriazoles, hydroxybenzophenones, hydroxymethoxybenzophenones and hydroxyphenylbenzotriazoles, dissolved in a fluid-repellent and soil-repellent fluorinated polymeric binder solution that is non-reactive with the UV absorbing compound, the ratio range of UV absorbing compound to repellent being from about 2-30% to 98-70%.

4. A fabric treatment composition according to claim 3 combined with a fluorinated hydrocarbon propellant.

5. A fabric treatment composition according to claim 4, wherein the UV absorbing compound comprises o-hydroxyphenylbenzotriazole and the propellant is selected from the group consisting of a fluorinated hydrocarbon propellant and a fluorinated-hydrocarbon/ethanol propellant mixture.

6. A fabric treatment composition according to claim 3, wherein the UV absorbing compound and the binder are present in amounts such that when said composition is applied as a thin layer of about 20 microns, the amount of UV absorbing compound in the layer is from about 0.1 gram per square foot to about 1 gram per square foot and the amount of binder in the layer is from about 0.1 gram per square foot to about 3 grams per square foot.

7. A fabric treatment spray which is effective to impart fade resistance and fluid and soil repellency to fabric and without impairing the hand, coloration, or flexibility of the fabric, and which comprises a UV absorbing compound selected from the group consisting of hydroxybenzotriazole, hydroxybenzophenones, hydroxymethoxybenzophenones, and hydroxyphenylbenzotriazoles, dissolved in a non-reactive fluid-repellent and soil-repellent polystyrene methyl methacrylate binder solution to permit spraying of particles of the combined ingredients in micron particle size in the range of 1 to 300 microns, the ratio range of UV absorbing compound to repellent being from about 2-30% to 98-70%.

8. A fabric treatment spray according to claim 7, wherein the limits of weight per square foot of spray, as applied in a thin layer of about 20 microns, are from about 0.1 gram per square foot to about 1 gram per square foot of UV absorbing compound and from about 0.1 gram per square foot to about 3 grams per square foot of binder solution.

9. A fabric treatment spray according to claim 7, wherein the UV absorbing compound is selected from the group consisting of hydroxybenzophenones and o-hydroxyphenylbenzotriazole.

10. A fabric treatment composition which is effective to impart fade resistance and fluid and soil repellency to fabric without impairing the hand, coloration, or flexibility of the fabric, and which comprises a UV absorbing compound selected from the group consisting of hydroxybenzotriazoles, hydroxybenzophenones, hydroxymethoxybenzophenones, and hydroxyphenylbenzotriazoles, dissolved in a fluid repellent and soil repellent polystyrene methyl methacrylate binder that is non-reactive with the UV absorbing compound, the ratio range of UV absorbing compound to repellent being from about 2-30% to 98-70%.

11. A fabric treatment composition according to claim 10 combined with a fluorinated hydrocarbon propellant.

12. A fabric treatment composition according to claim 11, wherein the UV absorbing compound comprises o-hydroxyphenylbenzotriazole and the propellant is selected from the group consisting of a fluorinated hydrocarbon propellant and a fluorinated-hydrocarbon/ethanol propellant mixture.

13. A fabric treatment composition according to claim 10, wherein the UV absorbing compound is selected from the group consisting of hydroxybenzophenones and hydroxybenzotriazoles.

14. A fabric treatment composition according to claim 10, wherein the UV absorbing compound and the binder are present in amounts such that when said composition is applied as a thin layer of about 20 microns, the amount of UV absorbing compound in the layer is from about 0.1 gram per square foot to about 1 gram per square foot and the amount of binder in the layer is from about 0.1 gram per square foot to about 3 grams per square foot.

15. A fabric treatment composition according to claim 10, wherein a fugitive dye indicator is admixed.

16. A fabric treatment spray which is effective to impart fade resistance and fluid and soil repellency to fabric without impairing the hand, coloration, or flexibility of the fabric, and which comprises a UV absorbing compound selected from the group consisting of hydroxybenzotriazoles, hydroxybenzophenones, hydroxymethoxybenzophenones, and hydroxyphenylbenzotriazoles, dissolved in a non-reactive fluid-repellent and soil-repellent polymer binder solution selected from the group consisting of a solution of fluorinated and polyfluorinated polymers and polystyrene methyl methacrylate binder solution to permit spraying of particles of the combined ingredients in micron particle size 1-300 microns, the ratio range of UV absorbing compound to repellent being from about 2-30% to 98-70%.

17. A fabric treatment spray according to claim 16, wherein a propellant is admixed selected from the group consisting of a fluorinated hydrocarbon propellant and a fluorinated hydrocarbon/ethanol propellant mixture.

* * * * *